US011434804B2

(12) United States Patent
Hisanaga et al.

(10) Patent No.: US 11,434,804 B2
(45) Date of Patent: Sep. 6, 2022

(54) EXHAUST PURIFICATION DEVICE

(71) Applicant: Marelli Corporation, Saitama (JP)

(72) Inventors: Tooru Hisanaga, Saitama (JP); Daisuke Sugaya, Saitama (JP); Tomoyuki Igarashi, Saitama (JP); Hitoshi Shimonosono, Saitama (JP)

(73) Assignee: Marelli Corporation, Saitama (JP)

( * ) Notice: Subject to any disclaimer, the term of this patent is extended or adjusted under 35 U.S.C. 154(b) by 0 days.

(21) Appl. No.: 17/056,318

(22) PCT Filed: Mar. 28, 2019

(86) PCT No.: PCT/JP2019/013551
§ 371 (c)(1),
(2) Date: Nov. 17, 2020

(87) PCT Pub. No.: WO2019/220789
PCT Pub. Date: Nov. 21, 2019

(65) Prior Publication Data

US 2021/0254531 A1 Aug. 19, 2021

(30) Foreign Application Priority Data

May 18, 2018 (JP) ..... JP2018-095966

(51) Int. Cl.
*F01N 3/28* (2006.01)
*F01N 13/14* (2010.01)

(52) U.S. Cl.
CPC ..... *F01N 3/2842* (2013.01); *F01N 3/2853* (2013.01); *F01N 13/145* (2013.01); *F01N 2260/08* (2013.01)

(58) Field of Classification Search
None
See application file for complete search history.

(56) References Cited

U.S. PATENT DOCUMENTS 4,004,888 A * 1/1977 Musall ..... F01N 3/2853 422/179
4,416,675 A * 11/1983 Montierth ..... B01D 46/247 55/502
6,555,070 B1 * 4/2003 Kruger ..... F01N 3/2853 422/179

FOREIGN PATENT DOCUMENTS

EP 1464798 A1 10/2004
JP H0310019 U 1/1991
(Continued)

OTHER PUBLICATIONS

JP2003049634A-translated document (Year: 2003).*
Kanematsu et al. JP2003049634A-translated document (Year: 2003).*

*Primary Examiner* — Jelitza M Perez
(74) *Attorney, Agent, or Firm* — Young Basile Hanlon & MacFarlane, P.C.

(57) ABSTRACT

An exhaust purification device has a catalytic converter provided with: an outer cylinder welded at the upstream end portion to an exhaust gas inlet of an inlet-side flange and welded at the downstream end portion to an exhaust gas outlet of the outlet-side flange. An inner cylinder has an upstream end portion held by the upstream side portion of the outer cylinder with no gap and has a downstream end portion disposed at the downstream side of the outer cylinder with a gap, the inner cylinder housing a catalyst support. An opening end is formed at the downstream end portion of the inner cylinder with a gap with respect to the outer cylinder, and a gas layer is formed by the exhaust gas having entered from the exhaust gas inlet and convected to an upstream side between the outer cylinder and the inner cylinder.

12 Claims, 9 Drawing Sheets

(56) References Cited

FOREIGN PATENT DOCUMENTS

| | | | | |
|---|---|---|---|---|
| JP | 2001012239 | A | | 1/2001 |
| JP | 2003020939 | A | | 1/2003 |
| JP | 2003049634 | A | * | 2/2003 |
| JP | 2003049634 | A | | 2/2003 |
| JP | 2009227190 | A | | 10/2009 |
| JP | 2016113969 | A | | 6/2016 |
| JP | WO2018078955 | A1 | | 8/2019 |

* cited by examiner

EXHAUST PURIFICATION DEVICE

CROSS-REFERENCE TO RELATED APPLICATION(S)

This application claims priority to Japanese Patent Application No. 2018-095966, filed on May 18, 2018, the entire contents of which are incorporated herein by reference.

TECHNICAL FIELD

The present invention relates to an exhaust purification device provided in an exhaust path of an automobile.

BACKGROUND

An exhaust purification device of this kind is disclosed, for example, in JP2016-113969A. The exhaust purification device disclosed in JP2016-113969A is an adiabatic exhaust flow pipe which comprises an inner cylinder and an outer cylinder provided on an outer periphery of the inner cylinder, wherein the inner cylinder and the outer cylinder are circumferentially welded at each of one end portion and the other end portion, the outer peripheral surface of the inner cylinder and the inner peripheral surface of the outer cylinder are spaced to form a gap between one end portion and the other end portion, and this gap constitutes an air layer; and further, an exhaust purifying body (catalyst support) is accommodated in a cylindrical portion.

SUMMARY

However, in the exhaust purification device of JP2016-113969A, since the outer cylinder holding the inner cylinder containing the catalyst support is in contact with the outside air, the outer cylinder actively performs heat exchange and is quickly cooled. Further, when the temperature of the catalyst support decreases, the exhaust gas cannot be purified. Therefore, it is necessary to operate an engine in order to maintain the temperature of the catalyst support, and fuel efficiency and emission are worse by operating the engine.

Accordingly, the present invention is intended to solve the problems mentioned above, and an object of the present invention is to provide an exhaust purification device that can keep the catalyst support warm.

This invention provides an exhaust purification device having a catalytic converter into which exhaust gas flows, the catalytic converter comprising: an outer cylinder having an upstream end portion serving as an inlet of the exhaust gas and a downstream end portion serving as an outlet of the exhaust gas; and an inner cylinder accommodating therein catalyst support for purifying the exhaust gas, the inner cylinder having an upstream end portion held with no gap on an upstream side of the outer cylinder and a downstream end portion disposed with a predetermined gap on a downstream side of the outer cylinder; wherein a gas layer is formed by the exhaust gas having flowed into an interior of the inner cylinder from the upstream end portion of the outer cylinder, having been discharged from the downstream end portion of the inner cylinder, and convected from the predetermined gap to an upstream side between the outer cylinder and the inner cylinder.

According to the present invention, since the exhaust gas flows from the downstream side between the outer cylinder and the inner cylinder of a hollow double tube structure to form the gas layer, the catalyst support can be kept warm.

Further, the inner cylinder can be thinned. Thereby, since the thermal mass is lowered, it is possible to improve the light-off performance.

DETAILED DESCRIPTION

Embodiments of the present invention will be described below with reference to the drawings.

Figure 1:
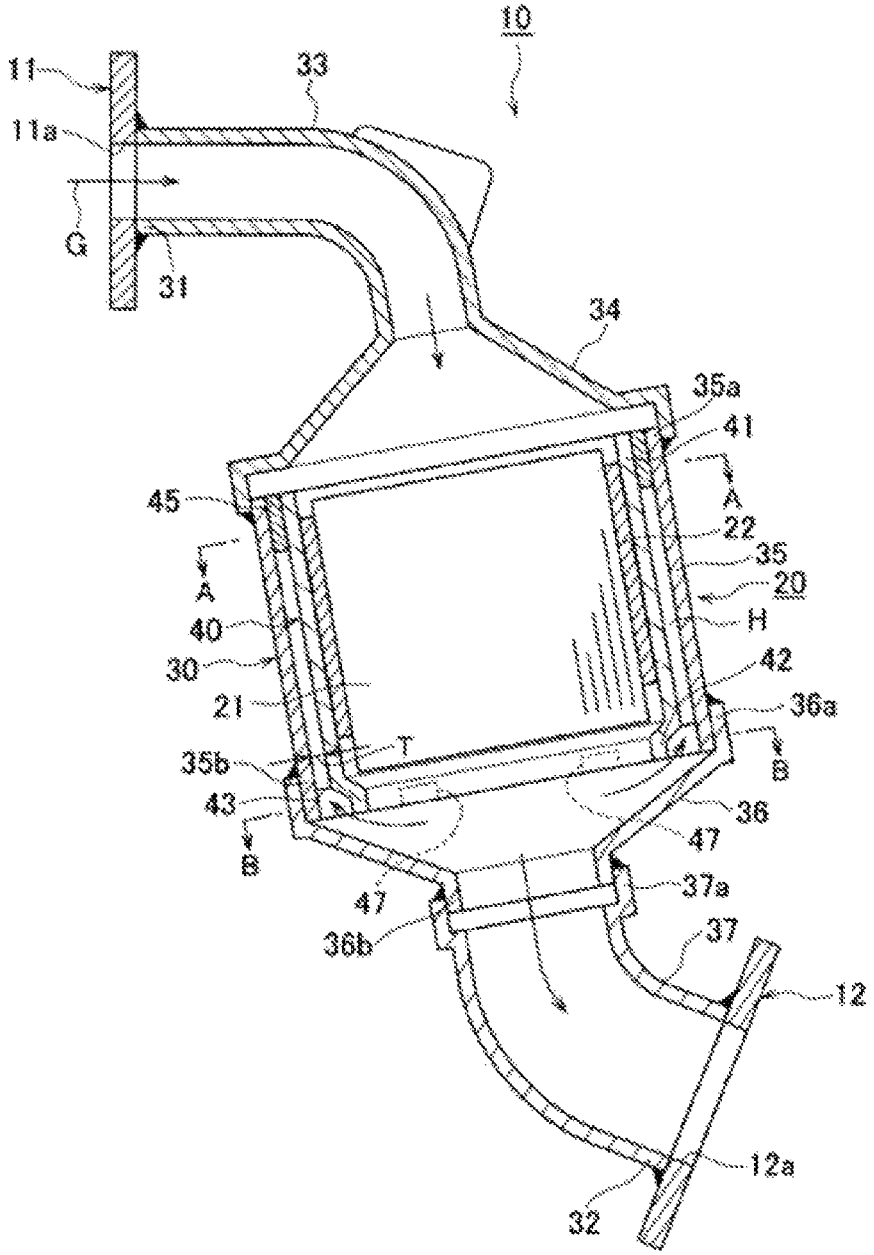
FIG. 1 is a cross-sectional view showing an exhaust purification device according to the first embodiment of the present invention.
Figure 2:
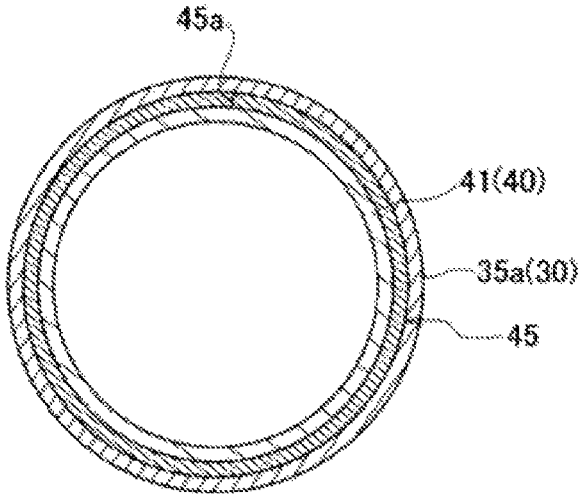
FIG. 2 is a cross-sectional view taken along the line A-A in FIG. 1.
Figure 3:
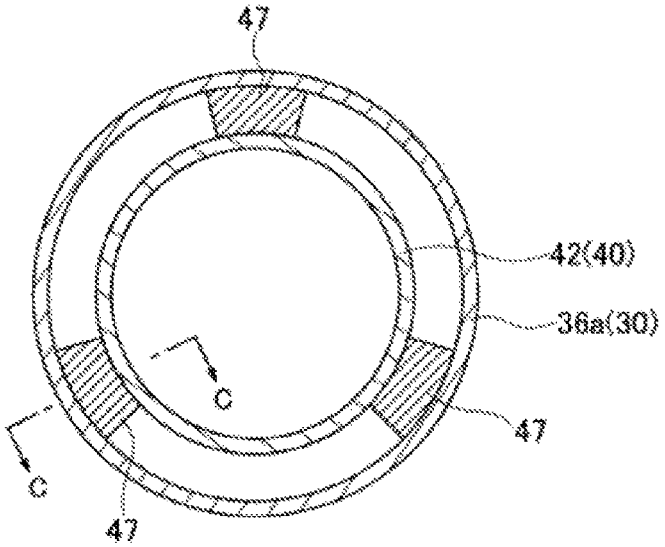
FIG. 3 is a cross-sectional view taken along the line B-B in FIG. 1.
Figure 4A:
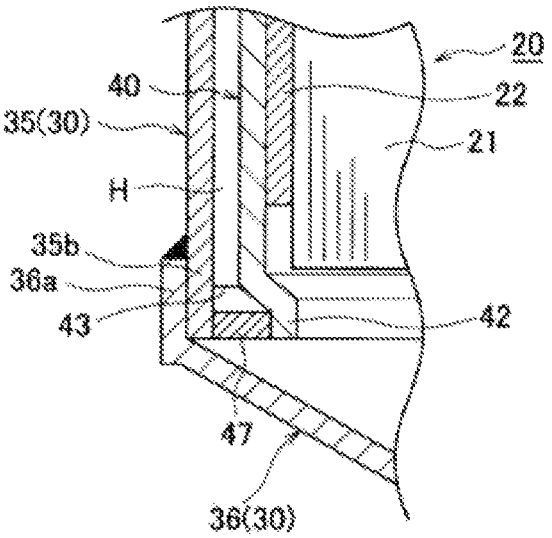
FIG. 4A is a cross-sectional view taken along the line C-C in FIG. 3.
Figure 4B:
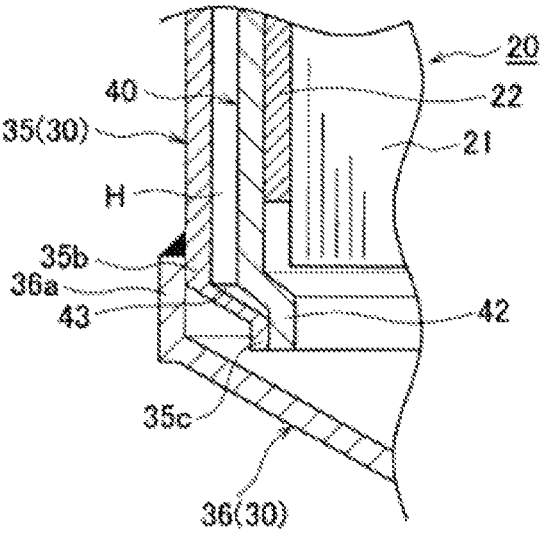
FIG. 4B is a cross-sectional view taken along the line C-C in FIG. 3 of a modified example.
Figure 5A:
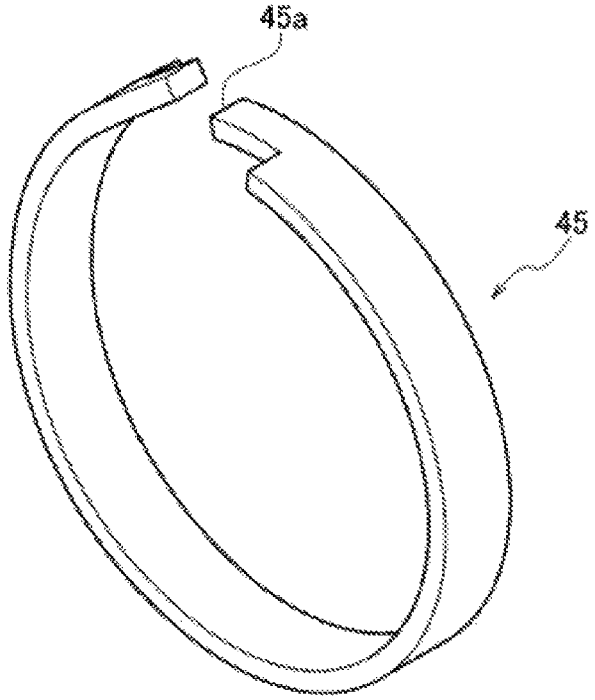
FIG. 5A is a perspective view showing a state before joining a seam portion of a sealing mat of the above-described exhaust purification device.
Figure 5B:
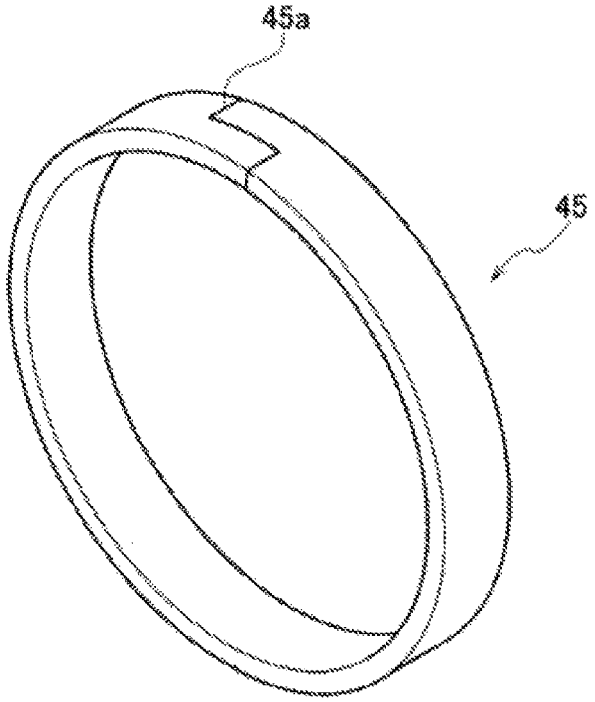
FIG. 5B is a perspective view showing a state after joining the seam portion of the same sealing mat.

FIG. 1 is a cross-sectional view showing an exhaust purification device according to the first embodiment of the present invention. FIG. 2 is a cross-sectional view taken along the line A-A in FIG. 1. FIG. 3 is a cross-sectional view taken along the line B-B in FIG. 1. FIG. 4A is a cross-sectional view taken along the line C-C in FIG. 3, and FIG. 4B is a cross-sectional view taken along the line C-C in FIG. 3 of a modified example. FIG. 5A is a perspective view showing a state before joining a seam portion of a sealing mat of the exhaust purifier, and FIG. 5B is a perspective view showing a state after joining the seam portion of the same sealing mat.

As shown in FIG. 1, the exhaust purification device 10 has a catalytic converter 20 between a metal inlet-side flange 11 located on an inlet side of exhaust gas G and a metal outlet-side flange 12 located on an outlet side of the exhaust gas G. The exhaust purification device 10 is a vertical type, perpendicular (upright) to a floor surface of a vehicle, with the inlet-side flange 11 placed on an upper side and the outlet-side flange 12 placed on a lower side.

The catalytic converter 20 comprises a metal outer cylinder 30 with an upstream end portion 31 fixed by welding to an exhaust gas inlet 11*a* of the inlet-side flange 11 and a downstream end portion 32 fixed by welding to an exhaust gas outlet 12*a* of the outlet-side flange 12; and a metal inner cylinder 40 accommodating therein catalyst support 21 for purifying the exhaust gas G, with an upstream end portion 41 held with no gap on an upstream side of the outer cylinder 30 and a downstream end portion 42 disposed with a gap on a downstream side of the outer cylinder 30.

The outer cylinder 30 has a cylindrical small-diameter portion 33, a conical cylindrical tapered portion 34, a large-diameter cylindrical base portion 35, a conical cylindrical tapered portion 36, and a cylindrical middle-diameter portion 37, from the upstream end portion 31 to the downstream end portion 32. The outer cylinder 30 accommodates the inner cylinder 40 in the large-diameter cylindrical base portion 35. The large-diameter cylindrical base portion 35 is fixed by welding to the conical cylindrical tapered portion 34 and 36 located on both sides. Further, a downstream end portion 36*b* of the conical cylindrical tapered portion 36 and an upstream end portion 37*a* of the cylindrical middle-diameter portion 37 are also fixed together by welding.

Figure 6A:
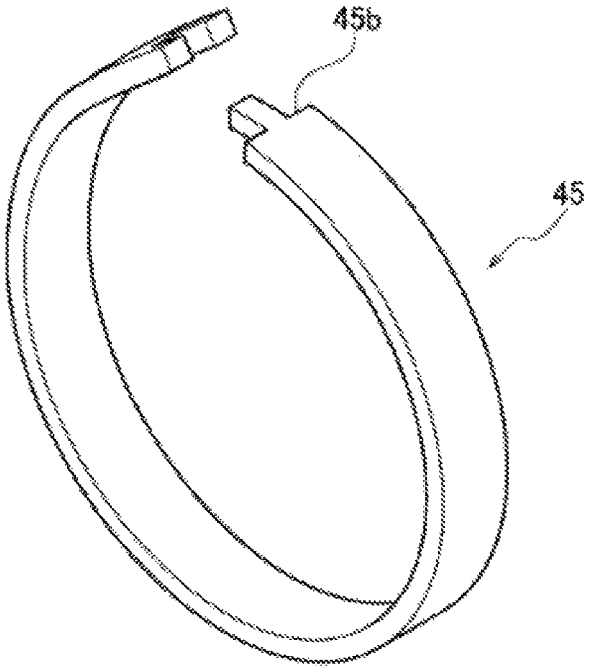
FIG. 6A is a perspective view showing a state before joining a seam portion of another example of the sealing mat.
Figure 6B:
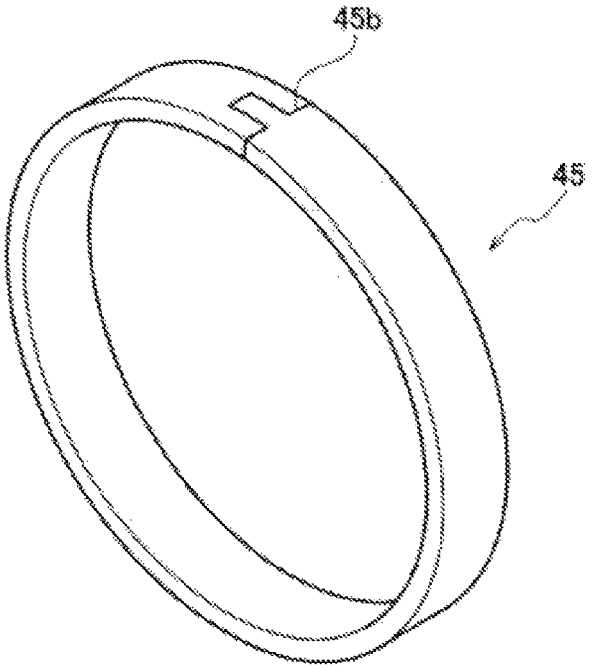
FIG. 6B is a perspective view showing a state after joining the seam portion of the same sealing mat.
Figure 7A:
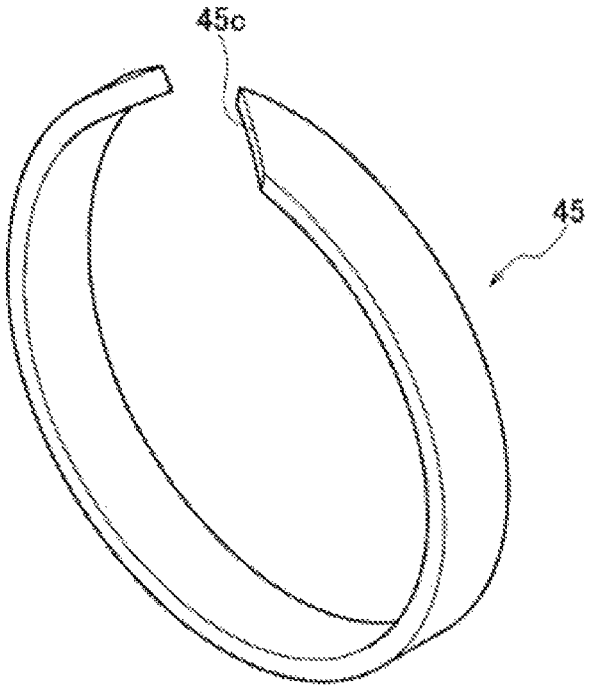
FIG. 7A is a perspective view showing a state before joining a seam portion of another example of the sealing mat.
Figure 7B:
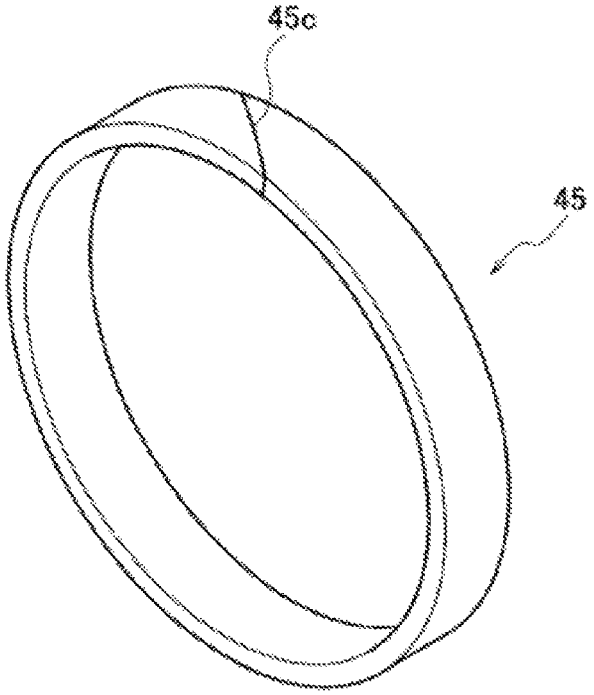
FIG. 7B is a perspective view showing a state after joining the seam portion of the same sealing mat.

As shown in FIG. 1 and FIG. 2, the inner cylinder 40 is formed in a cylindrical shape and the upstream end portion 41 side of the inner cylinder 40 is slidably sealed by a sealing mat (heat-insulating member) 45 interposed on the entire circumference between the upstream end portion 41 side and the upstream end portion 35*a* side of the large-diameter cylindrical base portion 35 of the outer cylinder 30. The sealing mat 45 as a heat-insulating member has a surface pressure (elastic force) capable of holding the inner cylinder 40. The sealing mat 45 is a low thermal conductivity. Furthermore, as shown in FIG. 2, FIG. 5A and FIG. 5B, the length of a seam portion 45*a* is formed to be longer than the lateral width of the sealing mat 45. Specifically, as shown in FIG. 5A and FIG. 5B, the end surface sides facing each other of the seam portion 45*a* of the sealing mat 45 are formed as a crank-shape, and the length of the sealing mat 45*a* is formed to be longer than the lateral width of the sealing mat 45. Thus, the exhaust gas G is difficult to leak. The shape of the seam portion 45*a* of the sealing mat 45, not limited to a crank-shape, may be formed such that the end surface sides facing each other have an uneven shape as in a seam portion 45*b* of the sealing mat 45 shown in FIG. 6A and FIG. 6B, or may be formed such that the end surface sides facing each other have an obliquely inclined plane shape as in a seam portion 45*c* of the sealing mat 45 shown in FIG. 7A and FIG. 7B.

Further, as shown in FIG. 1, FIG. 3, and FIG. 4A, a downstream end portion 35*b* of the large-diameter cylindrical base portion 35 of the outer cylinder 30 and the downstream end portion 42 of the inner cylinder 40 are fixed together by being partially welded via a plurality of intermediate members 47, so that the exhaust gas G can pass by and flow from the downstream end portion 42 side of the inner cylinder 40 toward the upstream end portion 36*a* side of the conical cylindrical tapered portion 36 of the outer cylinder 30. Thus, an opening end 43 having a predetermined gap T is formed between the downstream end portion 42 of the inner cylinder 40 and the downstream end portion 35*b* of the large-diameter cylindrical base portion 35 of the outer cylinder 30. Then, by allowing the exhaust gas G having flowed from the exhaust gas inlet 11*a* of the inlet-side flange 11 to convect from the opening end 43 of the inner cylinder 40 to the upstream side between the large-diameter cylindrical base portion 35 of the inner cylinder 40 and the outer cylinder 30, a gas layer H of the exhaust gas G is formed. Furthermore, the sum of the cross-sectional area of the predetermined gap T is set to be within 80% to 90% of the cross-sectional area between the outer cylinder 30 and the inner cylinder 40.

Incidentally, as shown in FIG. 4B, the downstream end portion 42 side of the inner cylinder 40 may be fixed by being welded to a protruding portion 35*c* partially projecting inwardly from the downstream end portion 35*b* side of the large-diameter cylindrical base portion 35 of the outer cylinder 30, so that the exhaust gas G can pass by and flow from the downstream end portion 42 side of the inner cylinder 40 toward the large-diameter cylindrical base portion 35 of the outer cylinder 30. Further, as shown in FIG. 1, the catalyst support 21 for purifying the exhaust gas G is attached to the inner cylinder 40 via a holding member 22.

As described above, according to the exhaust purification device 10 of the first embodiment, it is possible to form a gas layer H by the exhaust gas G that flows from the opening end 43 of the inner cylinder 40 on the downstream side into between the inner cylinder 40 and the large-diameter cylindrical base portion 35 of the outer cylinder 30 which is a hollow double tube structure. Therefore, when an automobile engine is stopped, the gas layer H having a high temperature exists around the catalyst support 21 of the catalytic converter 20, so that the catalyst support 21 is kept warm.

In addition, since the thickness of the inner cylinder 40 can be reduced, the catalyst of the catalyst support 21 can be activated at an early stage. Thereby, the light-off performance can be improved because the thermal mass is lowered.

Furthermore, since the exhaust purification device 10 is a vertical type with the inlet-side flange 11 placed on the upper side and the outlet-side flange 12 placed on the lower side, the exhaust gas G easily goes around between the large-diameter cylindrical base portion 35 and the inner cylinder 40 from the opening end 43 of the inner cylinder 40 on the downstream side.

Figure 8:
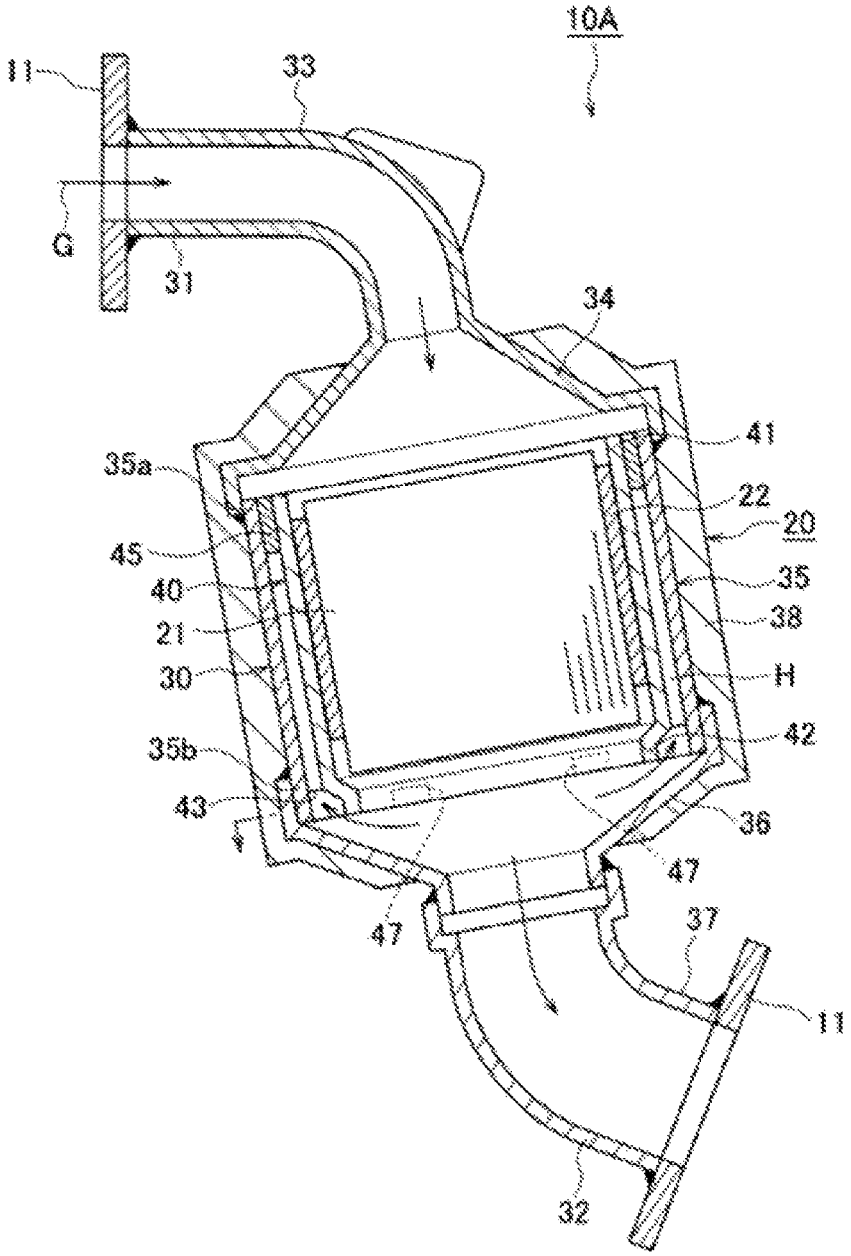
FIG. 8 is a cross-sectional view showing an exhaust purification device according to the second embodiment of the present invention.

FIG. 8 is a cross-sectional view showing an exhaust purification device according to the second embodiment of the present invention.

The exhaust purification device 10A of the second embodiment differs from the exhaust purification device 10 of the first embodiment in that the outside of the conical cylindrical tapered portion 34, the large-diameter cylindrical base portion 35, and the conical cylindrical tapered portion 36, of the outer cylinder 30, which are opposite to the inner cylinder 40, are covered with a heat-insulating/heat-shielding member 38. Incidentally, since other configurations are the same as those of the first embodiment, the same components are denoted by the same reference numerals, and detailed description thereof is omitted.

In the exhaust purification device 10A of the second embodiment, since the outside of the outer cylinder 30, which is opposite to the inner cylinder 40, is covered with the heat-insulating/heat-shielding member 38, the heat retention of the catalyst support 21 can be further enhanced when the automobile engine is stopped.

Figure 9:
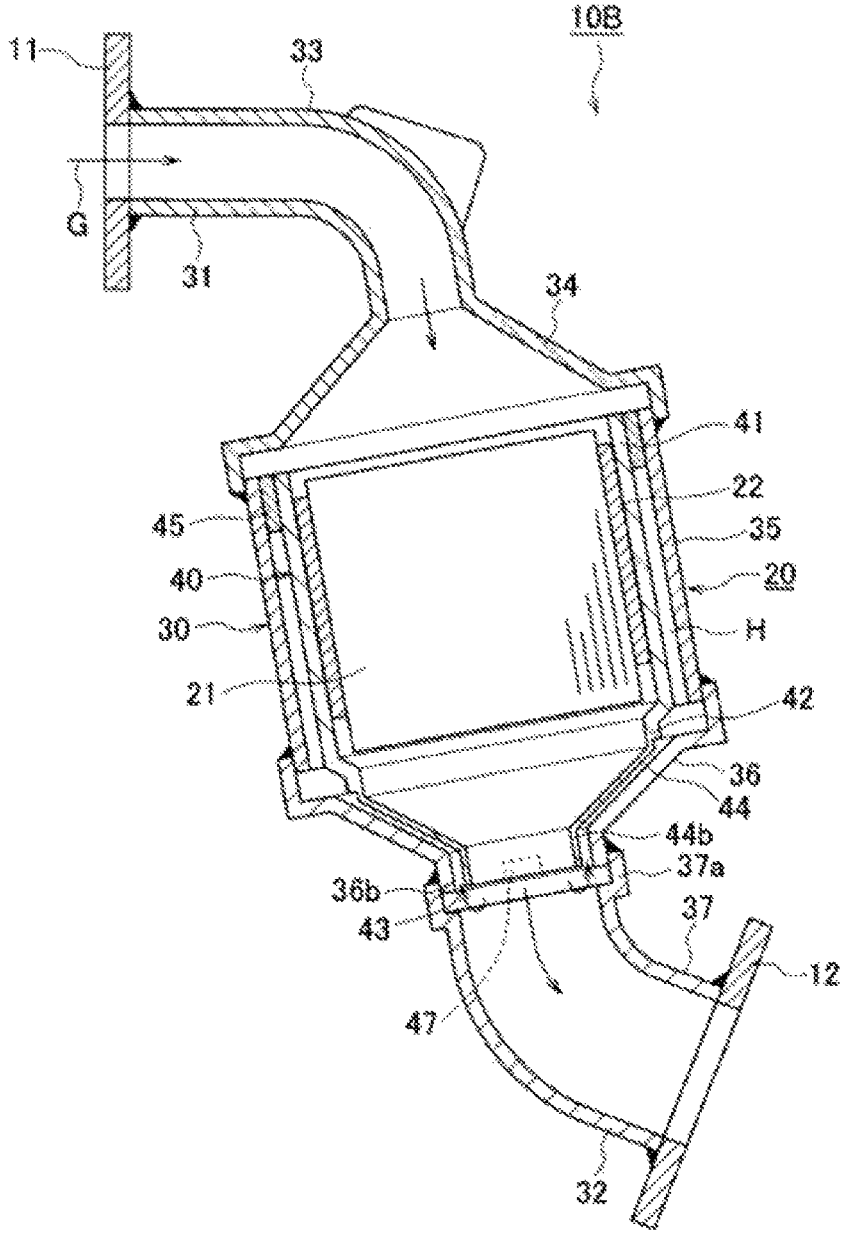
FIG. 9 is a cross-sectional view showing an exhaust purification device according to the third embodiment of the present invention.

FIG. 9 is a cross-sectional view showing an exhaust purification device according to a third embodiment of the present invention.

The exhaust purification device 10B of the third embodiment differs from the exhaust purification device 10 of the first embodiment in that an extended cylindrical portion 44 with a conical cylindrical distal end side and a cylindrical base side is attached to the downstream end portion 42 of the inner cylinder 40. The third embodiment also differs in that the downstream end portion 44*b* side of the extended cylindrical portion 44 is fixed to be partially welded to the downstream end portion 36*b* side of the conical cylindrical tapered portion 36 of the outer cylinder 30 via a plurality of intermediate members 47. Thereby, the exhaust gas G can pass by and flow from the downstream end portion 42 side of the inner cylinder 40 toward the large-diameter cylindrical base portion 35 of the outer cylinder 30. Incidentally, since other configurations are the same as those of the first embodiment, the same components are denoted by the same reference numerals, and detailed description thereof is omitted.

In the exhaust purification device 10B of the third embodiment, since the volume of the gas layer H by the exhaust gas G is made larger than that of the first embodiment, it is possible to further improve the heat retention of the catalyst support 21 when the engine of the automobile is stopped.

Figure 10:
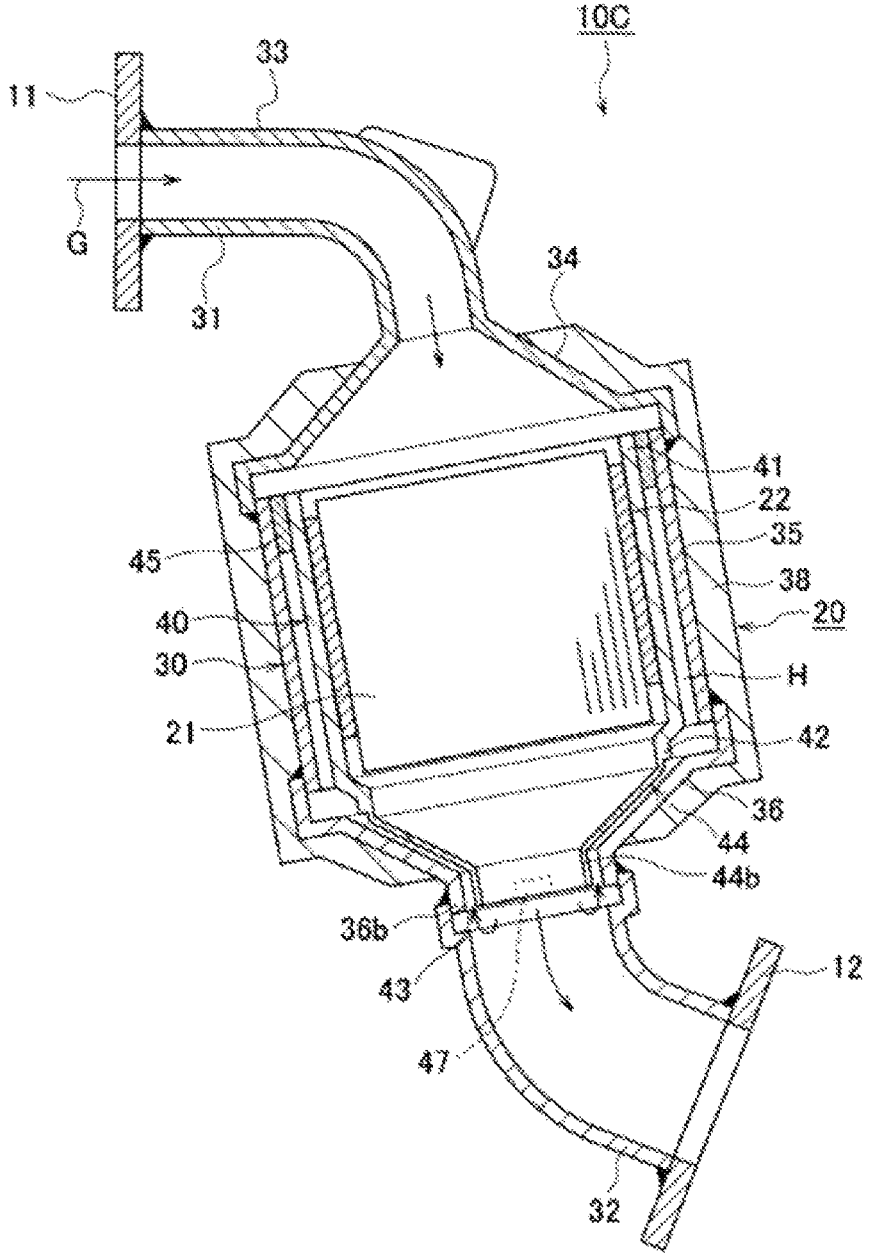
FIG. 10 is a cross-sectional view showing an exhaust purification device according to the fourth embodiment of the present invention.

FIG. 10 is a cross-sectional view showing an exhaust purification device according to the fourth embodiment of the present invention.

The exhaust purification device 10C of the fourth embodiment differs from the exhaust purification device 10B of the third embodiment in that the outside of the conical cylindrical tapered portion 34, the large-diameter cylindrical base portion 35, and the conical cylindrical tapered portion 36, of the outer cylinder 30, which are opposite to the inner cylinder 40, are covered with a heat-insulating/heat-shielding member 38. Incidentally, since other configurations are the same as those of the first embodiment, the same components are denoted by the same reference numerals, and detailed description thereof is omitted.

In the exhaust purification device 10C of the fourth embodiment, since the outside of the outer cylinder 30, which is opposite to the inner cylinder 40, is covered with a heat-insulating/heat-shielding member 38, the heat retention of the catalyst support 21 can be further enhanced when the automobile engine is stopped.

Incidentally, according to the above embodiments, the downstream end portion side of the inner cylinder is partially welded to the outer cylinder via the plurality of intermediate members so that the exhaust gas G can pass by and flow from the downstream end portion side of the inner cylinder toward the base portion of the outer cylinder. However, the downstream end portion side of the inner cylinder may be partially fixed to the outer cylinder via the plurality of heat-insulating members.

Further, according to the above embodiments, although the upstream end portion side of the inner cylinder is slidably sealed by a heat-insulating member interposed on the entire circumference between the upstream end portion side of the inner cylinder and the upstream end portion side of the outer cylinder, the downstream end portion side of the inner cylinder may be slidably held by heat-insulating members interspersed between the downstream end portion side of the inner cylinder and the downstream end portion side of the outer cylinder.

Furthermore, according to the above embodiments, although the vertical type with an exhaust purification device between the inlet-side flange and the outlet-side flange has been described, the exhaust purification device may be a horizontal type. Furthermore, it is possible to apply each of the embodiments described above, even in the type having a flange only on a side or having no flange on both sides.

While the contents of the present invention have been described along the embodiments, the present invention is not limited to these descriptions. Further, various modifications and improvements are possible to the extent obvious to those skilled in the art. The description and drawings that form a part of this disclosure are not limiting the present invention. Various alternative embodiments, examples, and operating techniques will be apparent to those skilled in the art from this disclosure.

It is needless to say that the present invention includes various embodiments and the like not described herein. Therefore, the technical scope of the present invention is defined only by the matters specifying the invention regarding the following claims that are reasonable from the above description.

The invention claimed is:

1. An exhaust purification device having a catalytic converter into which exhaust gas flows, the catalytic converter comprising:

an inner cylinder having an upstream end portion and a downstream end portion, the inner cylinder holding a catalyst support for purifying the exhaust gas; and an outer cylinder having an upstream end portion and a downstream end portion, the outer cylinder disposed with a gap to an outer periphery of the inner cylinder so as to surround the outer periphery of the inner cylinder; wherein the inner cylinder is slidably held via a first heat-insulating member having an elastic force to the upstream end portion of the outer cylinder in a flow direction of the exhaust gas of the outer cylinder, and is fixed by being welded to the downstream end portion of the outer cylinder in the flow direction of the exhaust gas of the outer cylinder; and the exhaust gas having passed through the catalyst support flows into the gap between the inner cylinder and the outer cylinder through an opening end between the downstream end portion of the inner cylinder and the downstream end portion of the outer cylinder in the flow direction of the exhaust gas.

2. The exhaust purification device according to claim 1, wherein the catalyst support is covered by at least the gap between the inner cylinder and the outer cylinder, and an upstream side of the gap in the flow direction of the exhaust gas is closed, and a downstream side is open in the flow direction of the exhaust gas, whereby a layer of exhaust gas forms and is retained between the inner cylinder and the outer cylinder to maintain heat in the catalyst support.

3. The exhaust purification device according to claim 1, wherein the opening end is open toward a lower side of a floor surface of a vehicle.

4. The exhaust purification device according to claim 1, wherein a conical cylindrical portion with a diameter increasing toward an upstream side in the flow direction of the exhaust gas is provided on the outer cylinder on the side where the opening end is provided.

5. The exhaust purification device according to claim 1, wherein the downstream end portion of the inner cylinder is partially welded to the outer cylinder via a plurality of intermediate members.

6. The exhaust purification device according to claim 1, wherein a sum of a cross-sectional area of the gap is within 80% to 90% of a cross-sectional area between the outer cylinder and the inner cylinder.

7. The exhaust purification device according to claim 1, wherein the first heat-insulating member is interposed on an entire circumference between the outer cylinder and the upstream end portion of the inner cylinder.

8. The exhaust purification device according to claim 1, wherein the downstream end portion of the inner cylinder in the flow direction of the exhaust gas is partially fixed to the outer cylinder via a plurality of second heat-insulating members.

9. The exhaust purification device according to claim 7, wherein a length of a seam portion of the first heat insulating member is formed so as to be longer than a lateral width of the first heat insulating member.

10. The exhaust purification device according to claim 1, wherein the outer cylinder accommodating the inner cylinder is disposed vertically perpendicular to a floor surface of a vehicle.

11. The exhaust purification device according to claim 1, wherein an outside of the outer cylinder opposite the inner cylinder is covered with a heat-insulating/heat-shielding member.

12. The exhaust purification device according to claim 1, wherein the inner cylinder extends continuously between the upstream end portion and the downstream end portion.

* * * * *